US009359121B1

(12) United States Patent
Hsieh

(10) Patent No.: US 9,359,121 B1
(45) Date of Patent: Jun. 7, 2016

(54) VACUUM SEALED CONTAINER FOR STORING FOODSTUFFS

(71) Applicant: Kuo Chin Hsieh, Kaohsiung (TW)

(72) Inventor: Kuo Chin Hsieh, Kaohsiung (TW)

( * ) Notice: Subject to any disclaimer, the term of this patent is extended or adjusted under 35 U.S.C. 154(b) by 0 days.

(21) Appl. No.: 14/665,108

(22) Filed: Mar. 23, 2015

(51) Int. Cl.
*B65D 81/20* (2006.01)
*B65D 41/04* (2006.01)
*B65D 51/16* (2006.01)

(52) U.S. Cl.
CPC ..... *B65D 81/2038* (2013.01); *B65D 41/0442* (2013.01); *B65D 51/1644* (2013.01)

(58) Field of Classification Search
CPC ..... B65B 31/02; B65B 31/04; B65D 81/20; B65D 81/2015; B65D 81/2038; B65D 81/2007
USPC ..... 141/8, 65; 53/432, 510; 99/472
See application file for complete search history.

(56) References Cited

U.S. PATENT DOCUMENTS 5,803,282 A * 9/1998 Chen ..... B65B 31/047 110/272
5,806,575 A * 9/1998 Tsay ..... B65D 81/2015 141/192
6,662,831 B2 * 12/2003 Chen ..... F04B 37/14 141/65
6,830,081 B1 * 12/2004 Chen ..... B65D 81/2038 141/65
6,968,870 B1 * 11/2005 Tsay ..... B65B 31/047 141/65
7,096,893 B2 * 8/2006 Vilalta ..... B65B 31/047 141/65
7,328,730 B2 * 2/2008 Vilalta ..... B65B 31/047 141/325
7,721,771 B2 * 5/2010 Tsay ..... B01J 3/03 141/65
8,113,246 B2 * 2/2012 Hsieh ..... A47J 47/10 141/197

* cited by examiner

*Primary Examiner* — Timothy L Maust
(74) *Attorney, Agent, or Firm* — Jackson IPG PLLC; Demian K. Jackson

(57) ABSTRACT

A food container is provided with a container body; a retaining ring; an inlet and outlet mechanism; and a cover. In response to securing the retaining ring to the inlet and outlet mechanism, securing the retaining ring to the container body, and connecting a second conductor to a second terminal of a micro switch, a pressure sensor pushes a resilient member to close the micro switch to supply power from a power source to a motor, a vacuum pump is activated by the motor, a plunger moves to block an open end of a second stop on a second pipe so as to remove air from the container body through a first pipe, the air is drawn into a closed space via an air inlet and a second opening, and the air enters the pressure sensor via a bossed hole, thereby producing a vacuum in the container body.

2 Claims, 11 Drawing Sheets

VACUUM SEALED CONTAINER FOR STORING FOODSTUFFS

BACKGROUND OF THE INVENTION

1. Field of the Invention

The invention relates to vacuum sealed food containers and more particularly to a vacuum sealed container for storing foodstuffs with improved characteristics.

2. Description of Related Art

A number of patents related to vacuum sealed food containers are disclosed. For example, U.S. Pat. No. 5,964,255 discloses a vacuum sealed apparatus for storing foodstuffs and comprises a battery powered vacuum pump integral with a base of a box, and a hinged lid on a top of the box for admitting food to be stored in partial vacuum.

However, the U.S. Pat. No. 5,964,255 suffers from a couple of disadvantages. For example, it is difficult of cleaning inside of the box because the vacuum pump is mounted in the base. Further, the partial vacuum may be difficult of being maintained because gap between the engaged lid and the box may be formed and increases after a period of time of use.

U.S. Pat. No. 8,113,246 discloses a vacuum fresh-keeping cover. However, the U.S. Pat. No. 8,113,246 suffers from a couple of disadvantages. For example, the check valve provided in the bottom of the container is not reliable. The engagement of the upper cover and the container may have gap there between after times of use and the gap can compromise the desired vacuum.

Notwithstanding the prior art, the invention is neither taught nor rendered obvious thereby.

SUMMARY OF THE INVENTION

It is therefore one object of the invention to provide a food storage container comprising a hollow container body for storing food; a retaining ring including internal threads, a central cylinder extending downward, a first opening through a bottom of the cylinder, and an annular latch disposed around a lower portion of the retaining ring, an annular first contact disposed around a top of the cylinder, and an annular second contact disposed on a bottom of the retaining ring adjacent to a joining portion of the bottom of the retaining ring and an inner surface of the retaining ring wherein the retaining ring and the container body are air tightly secured together after snapping the latch onto an inner portion of a top edge of the container body; an inlet and outlet mechanism including external threads on a lower portion of an outer surface, the external threads configured to secure to the internal threads for fastening the inlet and outlet mechanism and the retaining ring together, at least one power source on a bottom of the inlet and outlet mechanism, an air outlet through the bottom of the inlet and outlet mechanism, an air inlet adjacent to the air outlet, an inlet and outlet assembly, a frame, and a closed space defined by the inlet and outlet mechanism and the cover when the cover is secured to the inlet and outlet mechanism, first and second terminals, each electrically interconnected the at least one power source and a motor, first and second conductors, extending out of the at least one power source, and a micro switch mounted on the frame wherein the inlet and outlet assembly includes a sealing pad, a mounting board, an inlet and outlet plate, and a positioning board; wherein a second opening, first and second pipes, and a bossed hole are formed through the inlet and outlet plate; wherein a diaphragm is disposed between the inlet and outlet plate and the positioning board; wherein plastic first and second stops, are put on tops of the first and second pipes respectively; wherein the plastic second stop has an open end; wherein a first check valve is disposed on an open end of the plastic first stop, the first check valve being configured to allow air in the container body to exit via the open end of the plastic first stop; wherein the motor and the micro switch; wherein the first conductor is electrically connected to a first terminal of the micro switch and the second conductor is configured to electrically connect to a second terminal of the micro switch or not; wherein a resilient member is extended from the micro switch; wherein a flexible vacuum pump is mounted on the second opening; wherein a collapsible pressure sensor is disposed on the bossed hole and is fastened by the frame; wherein both the inlet and outlet assembly and the frame are releasably secured to the inlet and outlet mechanism; wherein the first pipe and the air outlet are connected together for air flow; wherein the second pipe and the air inlet are connected together for air flow; wherein the vacuum pump is operatively connected to the motor; and wherein the pressure sensor contacts the resilient member of the micro switch; and a cover including a top first hole aligned with the second pipe, a second check valve disposed in the first hole, an annular covering member mounted on the second check valve, a top second hole aligned with the second pipe, the second hole having a third opening at a first end, a detent member disposed at the third opening, a pivotal trigger disposed in the second hole and being rotatable about an intermediate pivot, a spring biased plate member disposed on an inner surface of a top of the cover, a peg extended downward from the trigger, a plunger mounted on an end of the peg and extending into the open end of the second stop, a sliding member extending out of the trigger, and a biasing member biased between the trigger and the sliding member wherein the sliding member partially extends into the third opening to be proximate to the detent member; wherein the pressure sensor is configured to collapse in response to force or pressured exerted thereon so as to cut power supplied from the at least one power source to the motor; wherein in response to securing the retaining ring to the inlet and outlet mechanism which is secured to the cover, securing the retaining ring to the container body, and connecting the second conductor to the second terminal of the micro switch, the pressure sensor pushes the resilient member to close the micro switch so as to supply power from the at least one power source to the motor for activation, the vacuum pump is activated by the motor, the plunger moves to block the open end of the second stop on the second pipe so as to remove air from the container body through the first pipe, the air is drawn into the closed space via the air inlet and the second opening, the air enters the pressure sensor via the bossed hole, thereby producing a vacuum in the container body, pressure in the closed space is increased to collapse the pressure sensor, and the resilient member moves to cut power supplied to the micro switch so as to deactivate both the motor and the vacuum pump; wherein in response to decreasing the pressure in the closed space to a predetermined value, the pressure sensor rebounds suddenly to push the resilient member so as to close the micro switch, and both the motor and the vacuum pump activate for removing air from the container body, thereby producing a vacuum in the container body; and wherein in response to pressing the trigger to pivotally move the sliding member toward the third opening until being caught by the detent member, the plate member moves to disengage the second conductor from the second terminal of the micro switch so as to deactivate the motor, move the plunger to clear out of the open end of the second stop, and allow air to enter the container body through the second pipe, thereby increasing pressure in the container body to a value about equal to the atmosphere.

The above and other objects, features and advantages of the invention will become apparent from the following detailed description taken with the accompanying drawings.

DETAILED DESCRIPTION OF THE INVENTION

Figure 1:
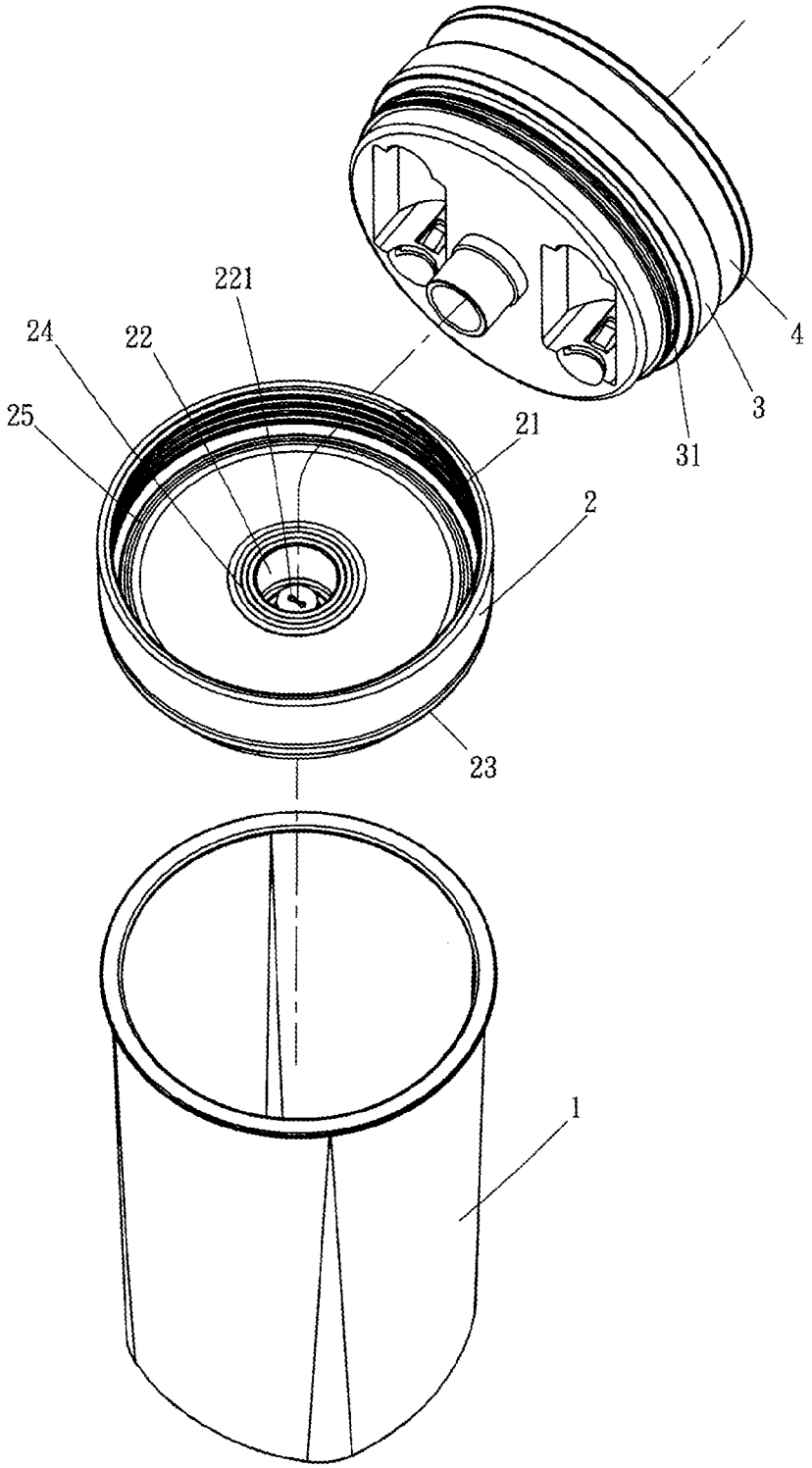
FIG. 1 is a perspective, exploded view of a vacuum sealed container for storing foodstuffs according to the invention.
Figure 2:
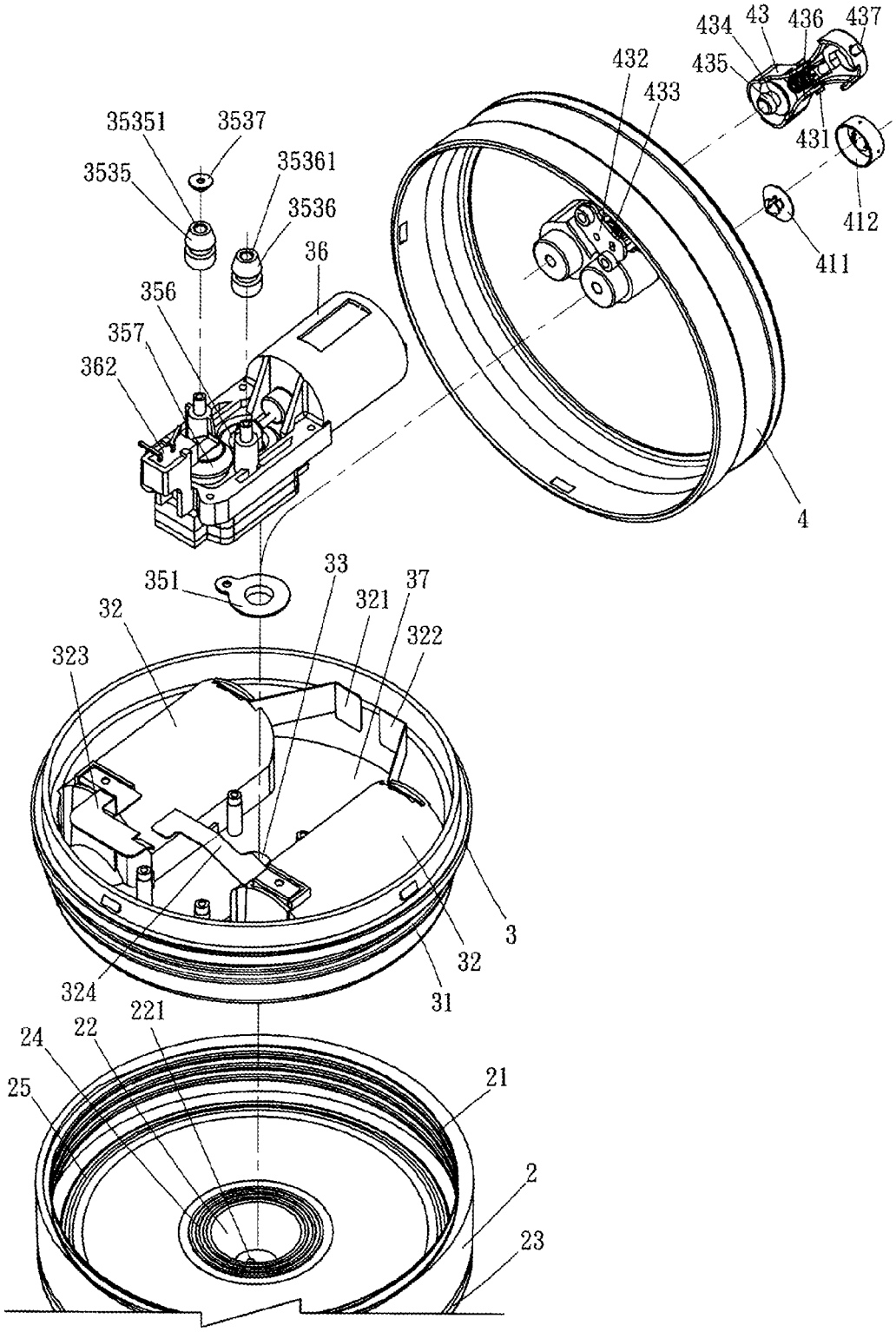
FIG. 2 is an exploded view of components provided in the cover.
Figure 3:
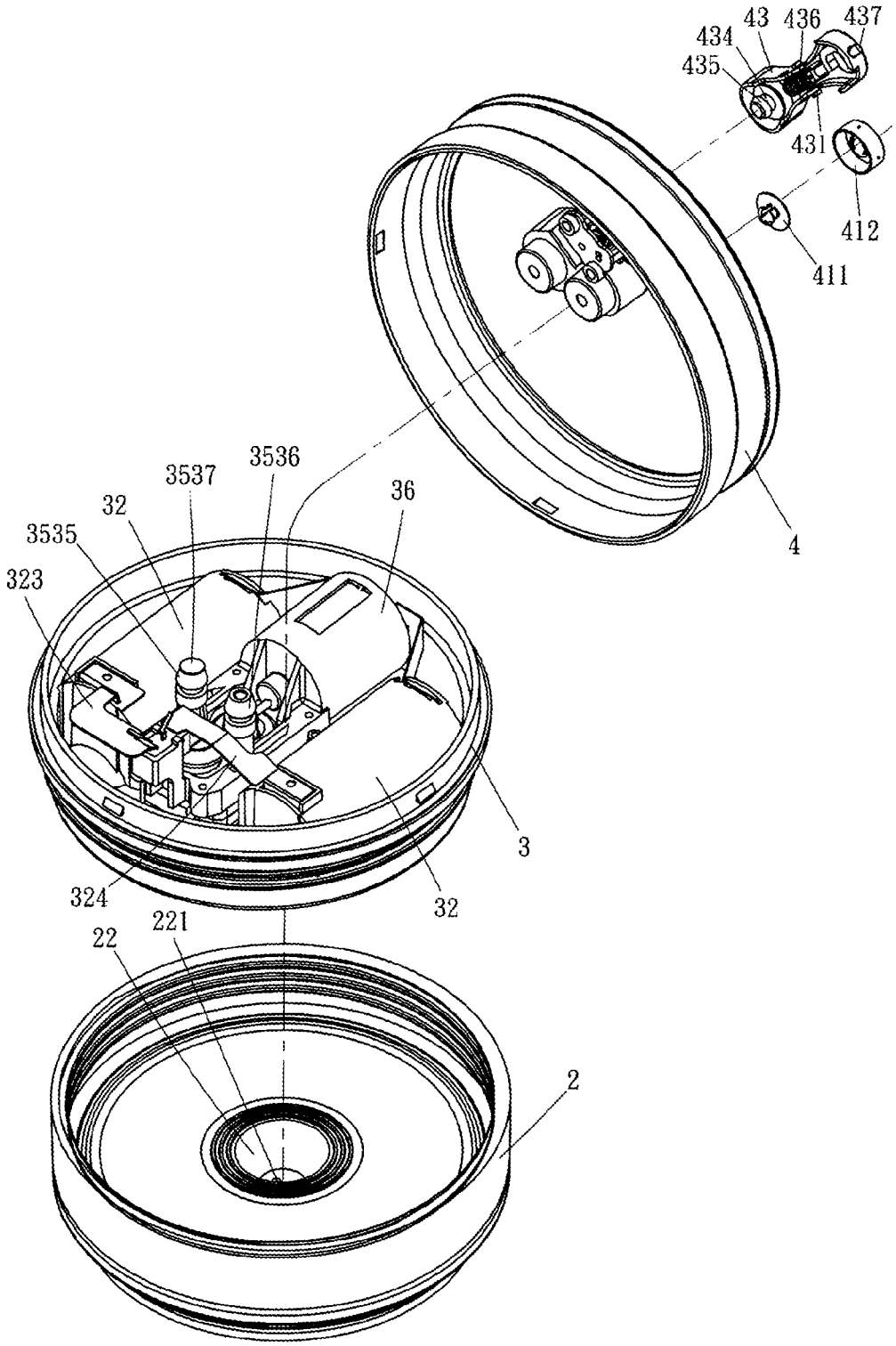
FIG. 3 is a view similar to FIG. 2 showing the frame being assembled in the inlet and outlet mechanism.
Figure 4:
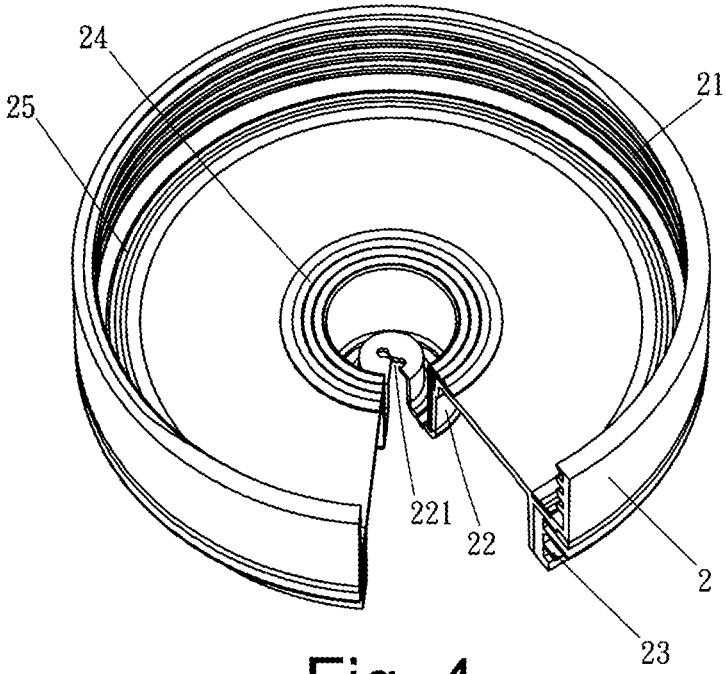
FIG. 4 is a partially broken away view of the retaining ring.
Figure 5:
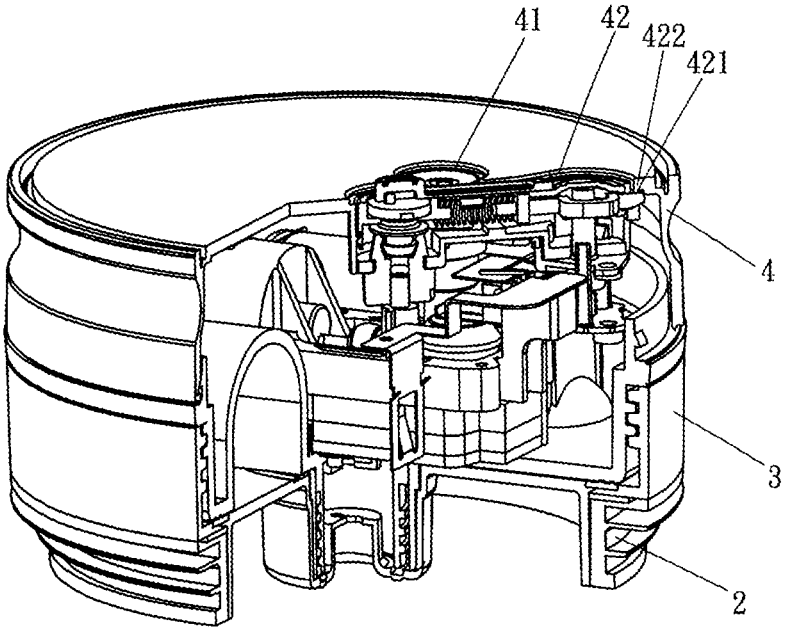
FIG. 5 is a partially broken away view of the assembled cover, the inlet and outlet mechanism, and the retaining ring.
Figure 6:
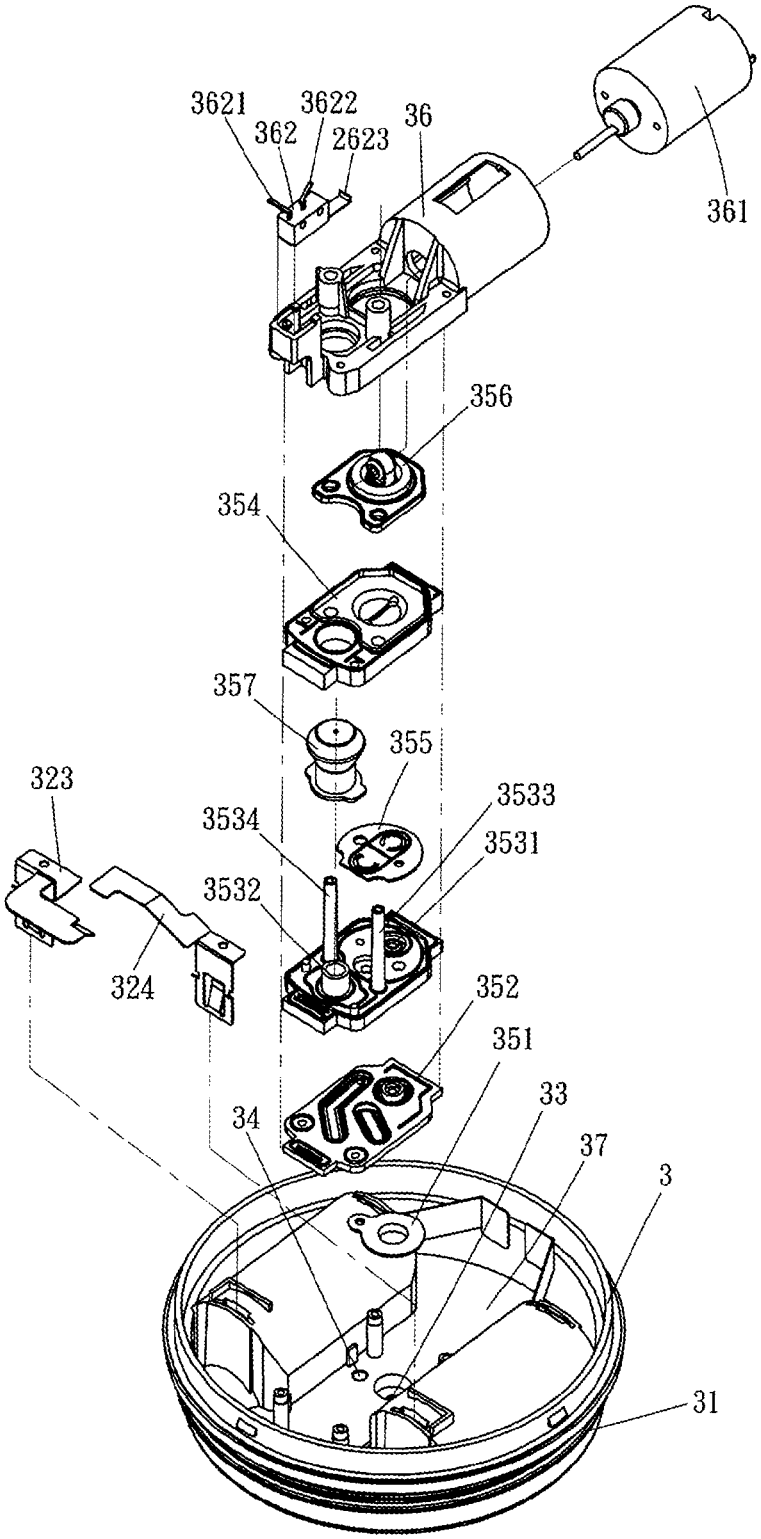
FIG. 6 is an exploded view of the inlet and outlet mechanism.
Figure 7:
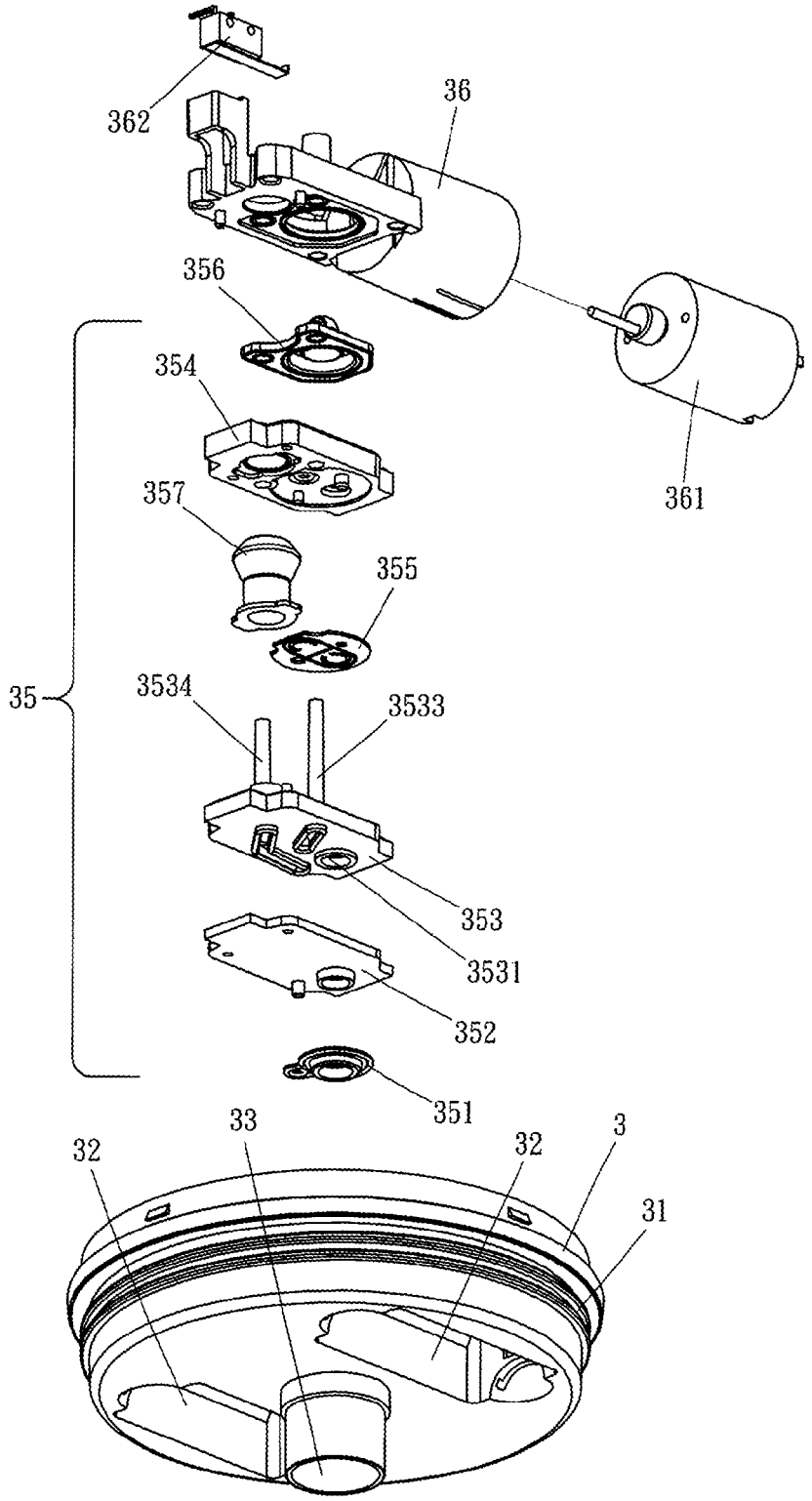
FIG. 7 is a view similar to FIG. 6 but viewing from an opposite angle.

Referring to FIGS. 1 to 14, a vacuum sealed container for storing foodstuffs in accordance with the invention comprises the following components as discussed in detail below.

A cylindrical container body 1, a retaining ring 2, an inlet and outlet mechanism 3, and a cover 4 are provided. Foodstuffs can be stored in the container body 1 through the open top of the container body 1. The retaining ring 2 includes internal threads 21, a central cylinder 22 extending downward, an opening 221 of double teardrop shape provided in a bottom of the cylinder 22 for air communication and preventing chips from passing through, an annular latch 23 made of elastomeric material and provided around a lower portion of the outer surface of the retaining ring 2, an annular first sealing member 24 made of elastomeric material provided around the top of the cylinder 22, and an annular second sealing member 25 made of elastomeric material provided on the bottom of the retaining ring 2 around a joining portion of the bottom of the retaining ring 2 and the inner surface of the retaining ring 2. The retaining ring 2 and the container body 1 can be secured together by snapping the latch 23 onto an inner portion of a top edge of the container body 1 and the fastening is airtight.

The cylindrical inlet and outlet mechanism 3 includes external threads 31 on a lower portion of an outer surface, the threads 31 configured to secure to the threads 21 for fastening the inlet and outlet mechanism 3 and the retaining ring 2 together, two battery compartments 32 on a bottom, an air outlet 33 through a central portion of the bottom, an air inlet 34 adjacent to the air outlet 33, an inlet and outlet assembly 35, and a frame 36. A closed space 37 is formed in the inlet and outlet mechanism 3 when the cover 4 is secured to the inlet and outlet mechanism 3 by snapping. Terminals 321, 322 each are electrically interconnected one end of a battery (not shown) and a DC (direct current) motor 361. Two conductors 323, 324 on the other ends of the battery compartments 32 are electrically connected to the batteries respectively and are electrically connected to form a circuit when a micro switch 362 is closed.

The inlet and outlet assembly 35 includes a sealing pad 351, a mounting board 352, an inlet and outlet plate 353, and a positioning board 354. An opening 3531, first and second pipes 3533, 3534, and a bossed hole 3532 are formed through the inlet and outlet plate 353. A diaphragm 355 is provided between the inlet and outlet plate 353 and the positioning board 354. Plastic first and second stops 3535, 3536 are put on top openings of the first and second pipes 3533, 3534 respectively. The plastic second stop 3536 has an open end 35361. An open end 35351 of the plastic first stop 3535 is provided with a first check valve 3537 which allows air in the container body 1 to exit via the open end 35351 of the plastic first stop 3535.

The motor 361 and the micro switch 362 are mounted in the frame 36. One conductor 323 is electrically connected to a first terminal 3621 of the micro switch 362. The other conductor 324 is brought to contact a second terminal 3622 of the micro switch 362. The electrical connection of the other conductor 324 and the second terminal 3622 of the micro switch 362 can be disconnected or connected by moving the second terminal 3622 of the micro switch 362. A resilient member 3623 is extended from the micro switch 362.

A flexible vacuum pump 356 is mounted on the opening 3531. A pressure sensor 357 is put on the bossed hole 3532 and is fastened by the frame 36. Further, both the inlet and outlet assembly 35 and the frame 36 are threadedly secured to the inlet and outlet mechanism 3. Thus, the first pipe 3533 and the air outlet 33 are connected together for air flow, and the second pipe 3534 and the air inlet 34 are connected together for air flow respectively. The vacuum pump 356 is operatively connected to the motor 361. Top of the pressure sensor 357 contacts the resilient member 3623 of the micro switch 362.

The cylindrical cover 4 includes a top first hole 41 aligned with the second pipe 3534, a second check valve 411 provided in the first hole 41, an annular covering member 412 mounted on the second check valve 411, a top second hole 42 aligned with the second pipe 3534, the second hole 42 having an opening 421 at one end and a detent member 422 at the opening 421, a pivotal trigger 43 in the second hole 42 and being rotatable about an intermediate pivot 431, a plate member 432 provided on an inner surface of a top of the cover 4, a spring 433 biased against the plate member 432, a peg 434 extended downward from the trigger 43, a plunger 435 mounted on an end of the peg 434 and extending into the open end 35361 of the second stop 3536, a sliding member 437 extending out of the trigger 43, and a spring 436 having both ends secured to the trigger 43 and the sliding member 437 respectively, one end of the sliding member 437 extending into the opening 421 to be proximate to the detent member 422.

Figure 8:
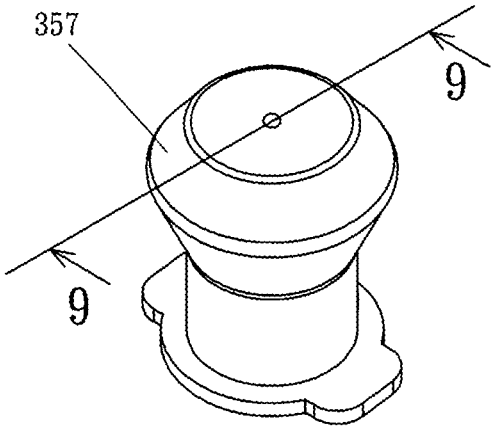
FIG. 8 is a perspective view of the pressure sensor.
Figure 9:
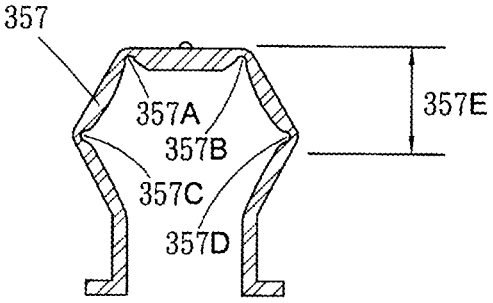
FIG. 9 is a sectional view taken along line 9-9 of FIG. 8.
Figure 10:
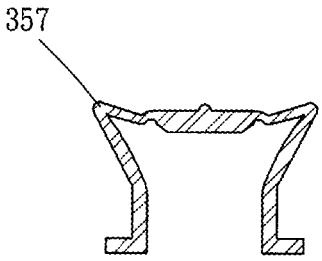
FIG. 10 is a view similar to FIG. 9 showing the collapsed pressure sensor after applying a downward force on its top.
Figure 11:
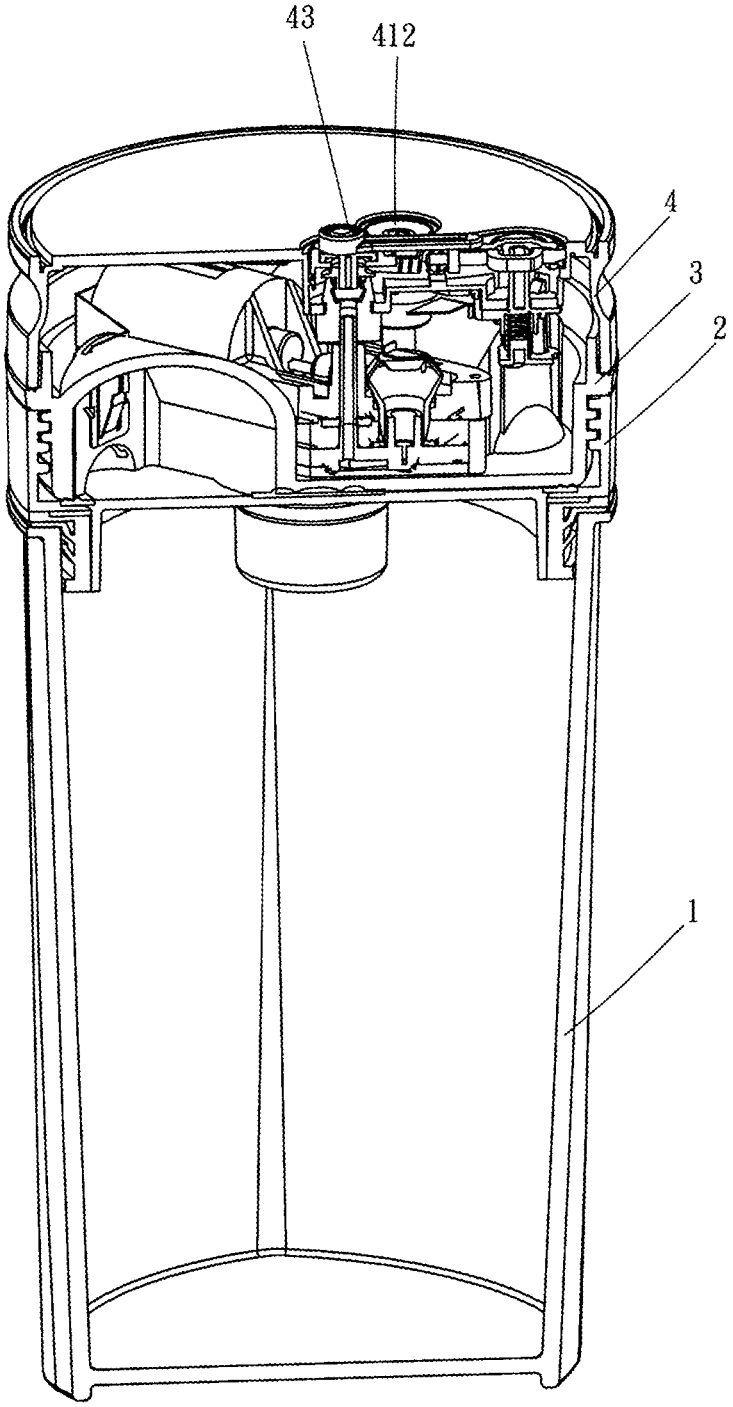
FIG. 11 is a broken away view of the vacuum sealed container.
Figure 12:
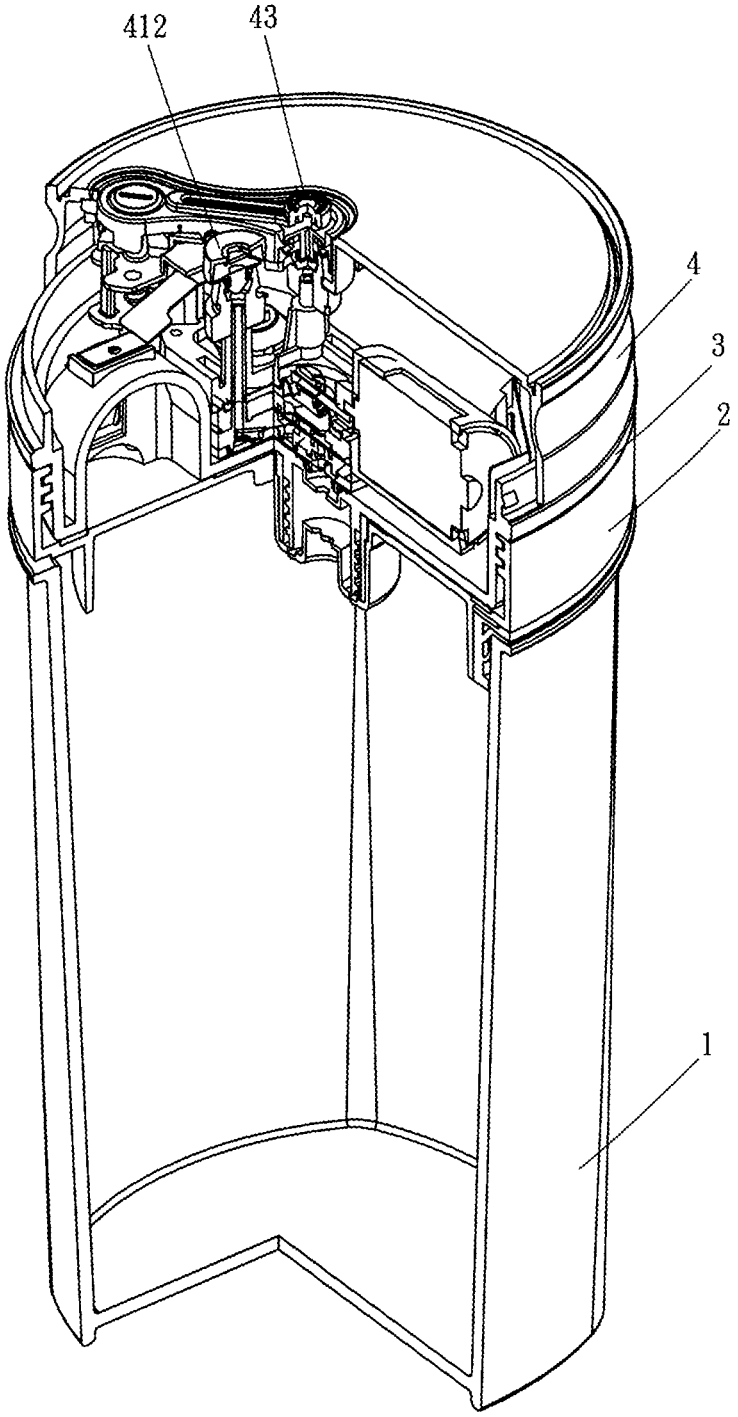
FIG. 12 is another broken away view of the vacuum sealed container.
Figure 13:
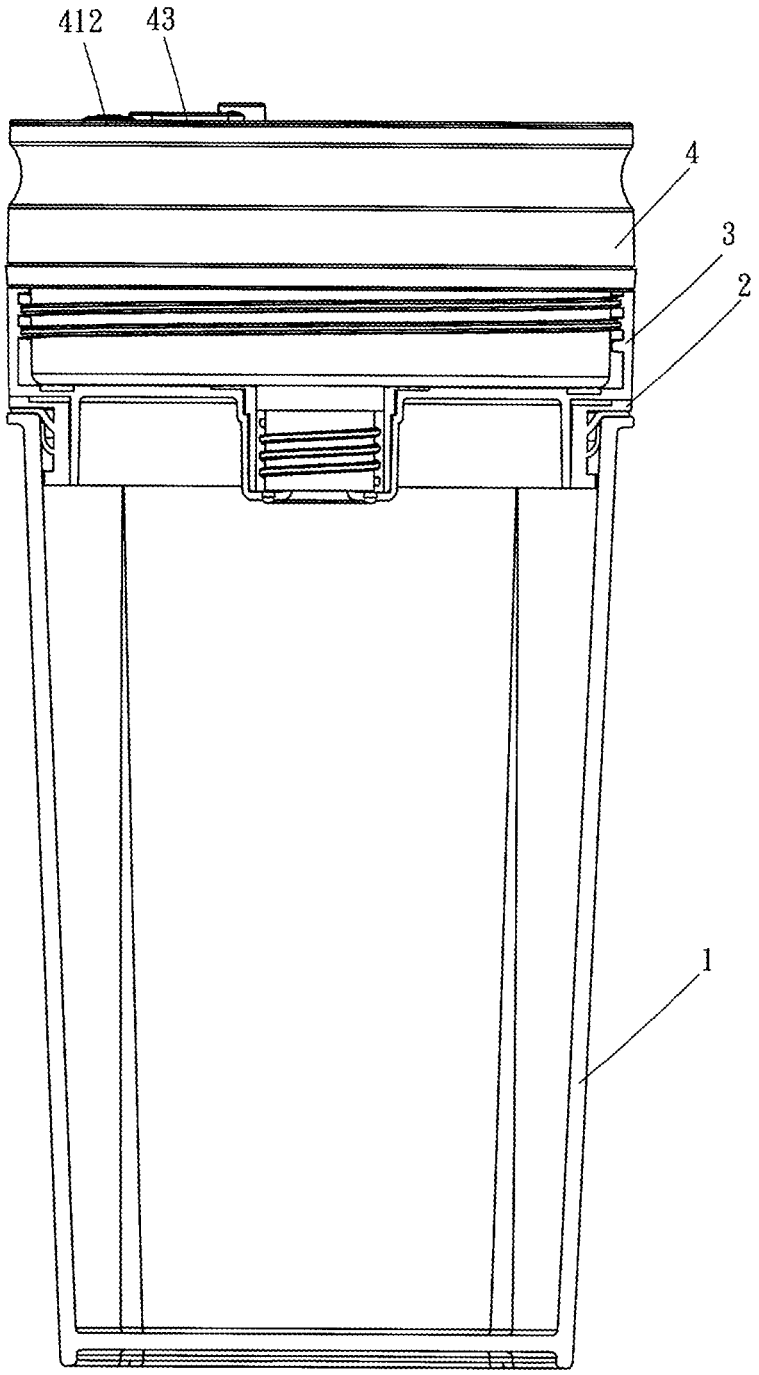
FIG. 13 schematically depicts the vacuum sealed container in a ready to use state.
Figure 14:
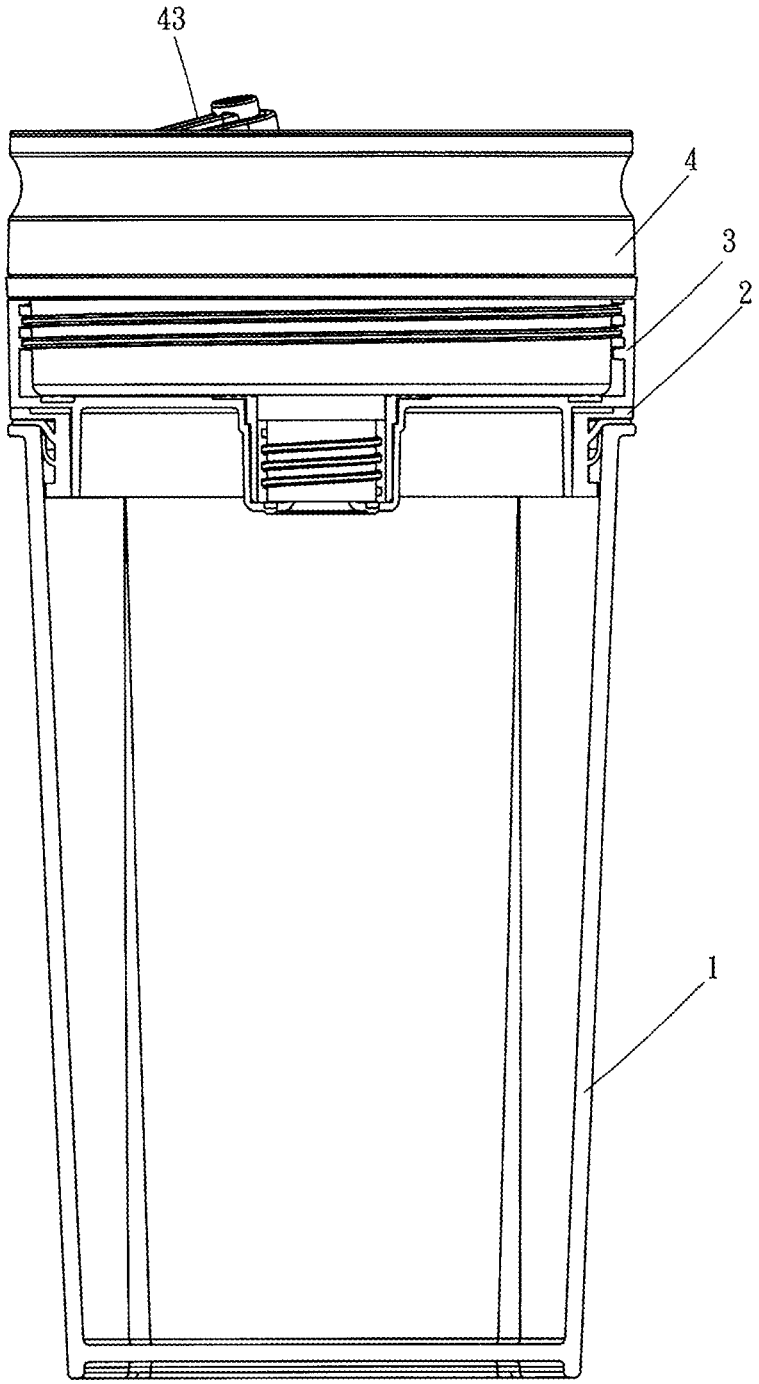
FIG. 14 is a view similar to FIG. 13 showing the vacuum sealed container in an operating state.

The pressure sensor 357 and the diaphragm 355 are separate and made of different materials. As shown in FIGS. 8, 9 and 10, the pressure sensor 357 is hollow and made of elastomeric material, and has four grooves 357A, 357B, 357C, 357D on an inner surface in which thickness of the pressure sensor 357 at each of the grooves 357A, 357B, 357C, 357D is the least. Thus, the pressure sensor 357 may be collapsed in response to force or pressured exerted thereon. The maximum collapsed extent of the pressure sensor 357 is indicated by 357E which is the distance about from the groove 357A to the groove 357C (or about from the groove 357B to the groove 357D). At this position, the power to the motor 361 is cut off and the vacuum pump 356 is deactivated.

After putting foodstuffs in the container body 1, a person may secure the retaining ring 2 (which is secured to the inlet and outlet mechanism 3 which is secured to the cover 4) to the container body 1 by snapping. As such, the foodstuffs are sealed. Also, the trigger 43 is disposed horizontally and the plate member 432 is raised. And in turn, the conductor 324 urges against and contacts the second terminal 3622 of the micro switch 352. Pressure in the closed space 37 is less than the atmospheric pressure. Thus, the pressure sensor 357 pushes the resilient member 3623 upward to close the micro switch 352. Power from the batteries is supplied to the motor 361 for activation. And in turn, the vacuum pump 356 is activated by the motor 361. Further, the plunger 435 lowers to block the open end 35361 of the second stop 3536 on the second pipe 3534. Thus, air in the container body 1 can be sucked out of the container body 1 through the first pipe 3533. Air may be drawn into the closed space 37 via the air inlet 34 and the opening 3531. Also, air may enter the pressure sensor 357 via the bossed hole 3532. As such, the container body 1 may be a vacuum. And in turn, pressure in the closed space 37 is increased to collapse the pressure sensor 357. Further, the resilient member 3623 is lowered to cut power supplied to the micro switch 362 (i.e., being open). Thus, both the motor 361 and the vacuum pump 356 are deactivated.

After a period of time passes, a small amount of air in the container body 1 may enter the closed space 37. Thus, pressure in the closed space 37 is decreased. And in turn, the pressure sensor 357 rebounds suddenly to push the resilient member 3623 upward so as to close the micro switch 362 by supplying power thereto. And in turn, both the motor 361 and the vacuum pump 356 activate for air suction purpose. As a result, a vacuum is produced in the container body 1.

For taking foodstuffs in the container body 1, a person may press the trigger 43 to pivotally move the sliding member 437 toward the opening 421 until being caught by the detent member 422. And in turn, the plate member 432 lowers to press the conductor 324 downward. As such, the conductor 324 disengages from the second terminal 3622 of the micro switch 362, thereby deactivating the motor 361. And in turn, the plunger 435 lifts to clear the open end 35361 of the second stop 3536. Thus, air may enter the container body 1 through the second pipe 3534, thereby increasing pressure in the container body 1 to be equal to the atmospheric pressure. Further, the person may detach the retaining ring 2, the inlet and outlet mechanism 3, and the cover 4 from the container body 1. Thus, it is easy to take foodstuffs out of the container body 1. Battery replacement can be made after detaching the retaining ring 2 from the inlet and outlet mechanism 3. For sucking air out of the container body 1, the person may turn the sliding member 437 in an opposite direction so that one end of the sliding member 437 may move out of the detent member 422 to be disposed in the opening 421. The plate member 432 is pushed upward by the spring 422. And in turn, the conductor 324 lifts to contact the second terminal 3622 of the micro switch 362, thereby activating the motor 361 and the vacuum pump 356.

While the invention has been described in terms of preferred embodiments, those skilled in the art will recognize that the invention can be practiced with modifications within the spirit and scope of the appended claims.

What is claimed is:

1. A food storage container comprising:

a hollow container body (1) for storing food;

a retaining ring (2) including internal threads (21), a central cylinder (22) extending downward, a first opening (221) through a bottom of the central cylinder (22), and an annular latch (23) disposed around a lower portion of the retaining ring (2), an annular first contact (24) disposed around a top of the central cylinder (22), and an annular second contact (25) disposed on a bottom of the retaining ring (2) adjacent to a joining portion of the bottom of the retaining ring (2) and an inner surface of the retaining ring (2) wherein the retaining ring (2) and the hollow container body (1) are air tightly secured together after snapping the annular latch (23) onto an inner portion of a top edge of the hollow container body (1);

an inlet and outlet mechanism (3) including external threads (31) on a lower portion of an outer surface, the external threads (31) configured to secure to the internal threads (21) for fastening the inlet and outlet mechanism (3) and the retaining ring (2) together, at least one power source (32) on a bottom of the inlet and outlet mechanism (3), an air outlet (33) through the bottom of the inlet and outlet mechanism (3), an air inlet (34) adjacent to the air outlet (33), an inlet and outlet assembly (35), a frame (36), and a closed space (37) defined by the inlet and outlet mechanism (3) and a cover (4) when the cover (4) is secured to the inlet and outlet mechanism (3), first and second terminals (321), (322) each electrically interconnected to the at least one power source (32) and a motor (361), first and second conductors (323, 324) extending out of the at least one power source (32), and a micro switch (362) mounted on the frame (36) wherein the inlet and outlet assembly (35) includes a sealing pad (351), a mounting board (352), an inlet and outlet plate (353), and a positioning board (354); wherein a second opening (3531), first and second pipes (3533, 3534), and a bossed hole (3532) are formed through the inlet and outlet plate (353); wherein a diaphragm (355) is disposed between the inlet and outlet plate (353) and the positioning board (354); wherein plastic first and second stops (3535, 3536) are put on tops of the first and second pipes (3533, 3534) respectively; wherein the plastic second stop (3536) has an open end (35361); wherein a first check valve (3537) is disposed on an open end (35351) of the plastic first stop (3535), the first check valve (3537) being configured to allow air in the container body (1) to exit via the open end (35351) of the plastic first stop (3535); wherein the first conductor (323) is electrically connected to a first terminal (3621) of the micro switch (362) and the second conductor (324) is configured to electrically connect to a second terminal (3622) of the micro switch (362) or not; wherein a resilient member (3623) is extended from the micro switch (362); wherein a flexible vacuum pump (356) is mounted on the second opening (3531); wherein a collapsible pressure sensor (357) is disposed on the bossed hole (3532) and is fastened by the frame (36); wherein both the inlet and outlet assembly (35) and the frame (36) are releasably secured to the inlet and outlet mechanism (3); wherein the first pipe (3533) and the air outlet (33) are connected together for air flow; wherein the second pipe (3534) and the air inlet (34) are connected together for air flow; wherein the flexible vacuum pump (356) is operatively connected to the motor (361); and wherein the collapsible pressure sensor (357) contacts the resilient member (3623) of the micro switch (362); and the cover (4) including a top first hole (41) aligned with the second pipe (3534), a second check valve (411) disposed in the first hole (41), an annular covering member (412) mounted on the second check valve (411), a top second hole (42) aligned with the second pipe (3534), the second hole (42) having a third opening (421) at a first end, a detent member (422) disposed at the third opening (421), a pivotal trigger (43) disposed in the second hole (42) and being rotatable about an intermediate pivot (431), a spring biased plate member (432) disposed on an inner surface of a top of the cover (4), a peg (434) extended downward from the trigger (43), a plunger (435) mounted on an end of the peg (434) and extending into the open end (35361) of the second stop (3536), a sliding member (437) extending out of the trigger (43), and a biasing member (436) biased between the trigger (43) and the sliding member (437) wherein the sliding member (437) partially extends into the third opening (421) to be proximate to the detent member (422);

wherein the collapsible pressure sensor (357) is configured to collapse in response to force or pressured exerted thereon so as to cut power supplied from the at least one power source (32) to the motor (361);

wherein in response to securing the retaining ring (2) to the inlet and outlet mechanism (3) which is secured to the cover (4), securing the retaining ring (2) to the container body (1), and connecting the second conductor (324) to the second terminal (3622) of the micro switch (352), the collapsible pressure sensor (357) pushes the resilient member (3623) to close the micro switch (352) so as to supply power from the at least one power source (32) to the motor (361) for activation, the flexible vacuum pump (356) is activated by the motor (361), the plunger (435) moves to block the open end (35361) of the second stop (3536) on the second pipe (3534) so as to remove air from the container body (1) through the first pipe (3533), the air is drawn into the closed space (37) via the air inlet (34) and the second opening (3531), the air enters the collapsible pressure sensor (357) via the bossed hole (3532), thereby producing a vacuum in the hollow container body (1), pressure in the closed space (37) is increased to collapse the collapsible pressure sensor (357), and the resilient member (3623) moves to cut power supplied to the micro switch (362) so as to deactivate both the motor (361) and the flexible vacuum pump (356);

wherein in response to decreasing the pressure in the closed space (37) to a predetermined value, the collapsible pressure sensor (357) rebounds suddenly to push the resilient member (3623) so as to close the micro switch (362), and both the motor (361) and the flexible vacuum pump (356) activate for removing air from the container body (1), thereby producing a vacuum in the hollow container body (1); and wherein in response to pressing the trigger (43) to pivotally move the sliding member (437) toward the third opening (421) until being caught by the detent member (422), the plate member (432) moves to disengage the second conductor (324) from the second terminal (3622) of the micro switch (362) so as to deactivate the motor (361), move the plunger (435) to clear out of the open end (35361) of the second stop (3536), and allow air to enter the hollow container body (1) through the second pipe (3534), thereby increasing pressure in the hollow container body (1) to a value about equal to the atmosphere.

2. The food storage container of claim 1, wherein the collapsible pressure sensor (357) is hollow and has four grooves (357A, 357B, 357C, 357D) on an inner surface.

* * * * *